US007232235B2

(12) United States Patent
Morrow

(10) Patent No.: US 7,232,235 B2
(45) Date of Patent: Jun. 19, 2007

(54) GRIPPING TOOL

(75) Inventor: David L. Morrow, Chester, CT (US)

(73) Assignee: Ben Hughes Communication Products Company, Chester, CT (US)

( * ) Notice: Subject to any disclaimer, the term of this patent is extended or adjusted under 35 U.S.C. 154(b) by 108 days.

(21) Appl. No.: 10/982,342

(22) Filed: Nov. 4, 2004

(65) Prior Publication Data

US 2005/0166722 A1 Aug. 4, 2005

Related U.S. Application Data

(60) Provisional application No. 60/517,005, filed on Nov. 4, 2003.

(51) Int. Cl.
*B25B 23/18* (2006.01)

(52) U.S. Cl. ..... 362/120; 362/109

(58) Field of Classification Search ..... 362/119–120, 362/109

See application file for complete search history.

(56) References Cited

U.S. PATENT DOCUMENTS 2,666,843 A * 1/1954 Zuckerman ..... 362/120
2,986,962 A * 6/1961 Ford ..... 81/383
3,287,547 A * 11/1966 Spedding ..... 362/119
4,802,390 A * 2/1989 Warheit ..... 81/341
5,921,654 A * 7/1999 Coyle ..... 362/120
6,296,365 B1 * 10/2001 McCalla et al. ..... 362/119
6,473,925 B1 * 11/2002 Konen ..... 7/107
6,921,654 B2 * 7/2005 Abu-Threideh et al. .... 435/194
6,988,814 B1 * 1/2006 Correa ..... 362/109

OTHER PUBLICATIONS

Panduit Corp., Onine brochure for Opticom HD Tools and Accessories, May 12, 2005.
Richco, Inc., New product release for Fiber Connector Extraction Tool, Nov. 30, 2003, Chicago, IL.
Optimark Fiber Optics, Brochure for Optimark OPT SF-1 Fiber Optic Connector Insertion/Extraction Tool, Jul. 21, 2004, Chestnut Hill, MA.

* cited by examiner

*Primary Examiner*—Ali Alavi
(74) *Attorney, Agent, or Firm*—Michaud-Duffy Group LLP

(57) ABSTRACT

In a gripping tool a first body member defines a first jaw portion and a first handle portion. The second body member defines a second jaw portion and a second handle portion. The first and second handle portions being coupled to one another at distal ends for movement between and open position and a gripping position. A spring is provided for normally urging at least one of the first and second body members toward the open position. The first and second jaw portions are adapted to grasp an object position between them in response to the body members being moved from the open position to the gripping position.

20 Claims, 2 Drawing Sheets

GRIPPING TOOL

CROSS-REFERENCE TO RELATED APPLICATIONS

This application is entitled to the benefit of and incorporates by reference essential subject matter disclosed in Provisional Patent Application No. 60/517,005 filed on Nov. 4, 2003.

BACKGROUND OF THE INVENTION

Often equipment today, particularly electronic and telecommunications equipment requires the use of a great many cable connections. These connections typically require that some sort of terminal be plugged into a mating receptacle. These connections are generally closely packed making it difficult for a person to make the connections by hand. Depending on the environment, tools such as pliers, or the like are not configured to fit into the narrow spaces between the connection points.

Accordingly, there exists a current need for a tool that provides a user with the ability to make the above-described connections with little difficulty. It is the general object of the present invention to provide a gripping tool that improves upon or overcomes the problems and drawbacks associated with the prior art.

SUMMARY OF THE INVENTION

The present invention is directed to a gripping tool that includes a first body member that defines a first jaw portion and a first handle portion. A second body member is included that defines a second jaw portion and a second handle portion. The first and the second handle portions are coupled to one another at distal ends thereof for movement between an open position and a gripping position. Biasing means are provided for normally urging at least one of the first and second body members toward the open position.

The first and second jaw portions each include gripping means for graspingly engaging an object positioned between the first and second jaw portions in response to the first and second body members being moved from the open position to the gripping position.

Preferably, a light source is positioned between and retained by at least one of the first and second body portions and is directed toward the first and second jaw portions to illuminate an object positioned there between. In the preferred embodiment of the present invention, the light source is a pen light removably interposed between the first and the second body members.

DETAILED DESCRIPTION OF THE PREFERRED EMBODIMENTS

Figure 1:
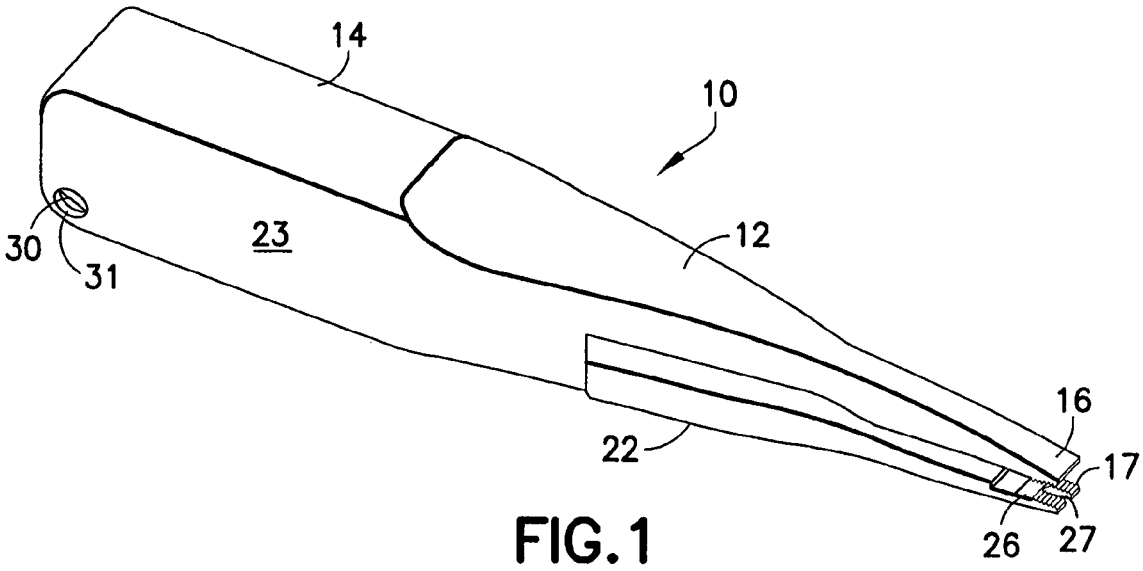
FIG. 1 is a perspective view of the gripping tool of the present invention.
Figure 2:
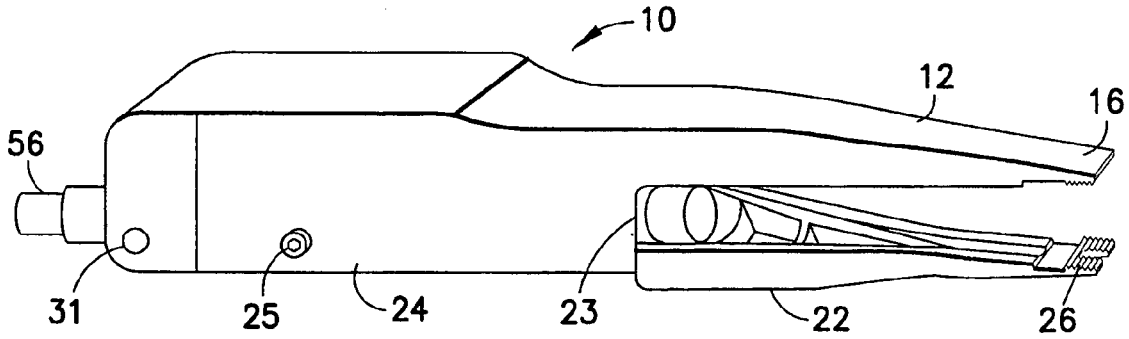
FIG. 2 is a perspective view of the gripping tool of the present invention showing a pen light positioned between body members of the gripping tool.
Figure 3:
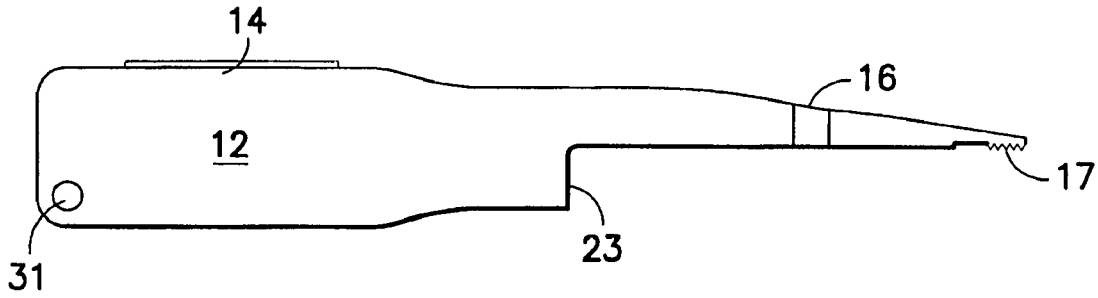
FIG. 3 is a side view of a first body member that forms part of the gripping tool of the present invention.

Referring to FIGS. 1-5, a gripping tool according to the present invention is generally designated by the reference number 10 and has a first body member 12 and a second body member 22. The first body member 12 has a handle portion 14 and a jaw portion 16. Likewise, the second body member 22 has a handle portion 24 and a jaw portion 26. The gripping tool 10 is shown in an open position in FIG. 2 wherein the jaw portion 16 of the first body member 12 is spaced away from the jaw portion 26 of the second body member 22. Referring back to FIG. 1, the gripping tool 10 is shown in a gripping position with the first and second jaw portions, 16 and 26 respectively, shown in a semi-closed position wherein an object can be grasped there between. The first body member 12 defines a skirt portion 23 that overlaps a portion of the second body member 22 during movement of the gripping tool between the open and the gripping positions.

Preferably, the first and second body members, 12 and 22 respectively, are formed from a dielectric material such as a plastic so that the tool does not conduct electric current or create sparks when contacting metal objects. However, the present invention is not limited in this regard as ceramic, metals or other materials may also be used. In addition, while tips of the jaw portions, 16 and 26 are shown in the illustrated embodiment as being integrally formed with the first and second body members, 12 and 22 respectively, the present invention is not limited in this regard as the tips of the jaw portions can be removable to accommodate different tips adapted to different tasks.

Figure 4:
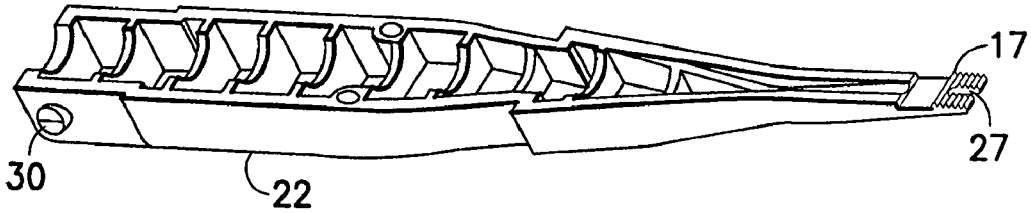
FIG. 4 is a perspective view of a second body member that forms part of the gripping tool of the present invention.
Figure 5:
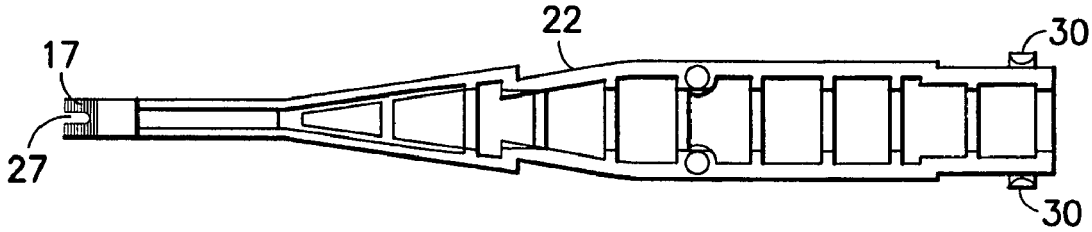
FIG. 5 is a top view of the second body member of FIG. 4.

As shown in FIG. 1, and best seen in FIGS. 4 and 5, the second body member 22 defines a pair of generally opposed, outwardly projecting pins 30. These pins 30 are adapted to be pivotally received in generally opposed apertures 31 defined by the handle portion 14 of the first body member 12 thereby pivotally joining the first and second body members, 12 and 22 respectively, together. The first and second body members, 12 and 22 respectively, are normally urged toward the open position by a spring, not shown, interposed between the first and second body members.

In the illustrated embodiment, the first and second jaw portions, 16 and 26 respectively, each define serrations 17 to facilitate the gripping of objects. In addition, the second jaw portion 22 defines a slot 27 extending from a tip of the second jaw portion. The slot 27 is adapted to accommodate a portion of a connector, such as, for example, the depressible tab on a standard telephone connector. During operation, the telephone connector can be gripped such that the tab is positioned in the slot 27, thereby facilitating its insertion into an appropriate receptacle. While serrations have been shown and described, the present invention is not limited in this regard as other gripping means, such as but limited to an elastomeric layer or even a flat surface can be provided without departing from the broader aspect of the present invention. Moreover, while gripping means have been shown and described as being defined by both the first and the second jaw portions, the present invention is not limited in this regard as only one of the jaw portions could define gripping means without departing from the broader aspects of the present invention.

Referring again to FIG. 2, the gripping tool 10 can be adapted to removably receive a light source, shown in the illustrated embodiment as a pen light 56. The pen light 56 is disposed between the first and second body members, 12 and 22 respectively so that light emanating therefrom is directed towards the first and second jaw portions, 16 and 26 respectively.

The handle portions 14 and 24 of the gripping tool 10 can include limiting means, shown in the illustrated embodiment as a screw 25 to restrict the amount by which the first and second jaw portions, 16 and 26 respectively, can be brought together. While a screw 25 has been shown and described, the present invention is not limited in this regard as other means can be employed to restrict the amount by which the first and second jaw portions, 16 and 26 respectively, can be brought together. For example, a boss or other protuberance projecting outwardly from the second body member 22 can be positioned to contact and stop the movement of the first body member 12.

The foregoing description of embodiments of the invention has been presented for the purpose of illustration and description, it is not intended to be exhaustive or to limit the invention to the form disclosed. Obvious modifications and variations are possible in light of the above disclosure. The embodiments described were chosen to best illustrate the principals of the invention and practical applications thereof to enable one of ordinary skill in the art to utilize the invention in various embodiments and with various modifications as suited to the particular use contemplated. It is intended that the scope of the invention be defined by the claims appended hereto.

What is claimed is:

1. A gripping tool comprising:

a first body member formed from a dielectric material, the first body member defining a first jaw portion and a first handle portion, the first jaw portion extending longitudinally outward from the first handle portion;

a second body member formed from a dielectric material, the second body member defining a second jaw portion and a second handle portion, the second jaw portion extending longitudinally outward from the second handle portion;

the first and the second body members are pivotally coupled to one another at distal ends of their respective handle portions wherein a downward force applied to the body members moves the body members into a substantially parallel arrangement between an open position and a gripping position;

biasing means for normally urging at least one of the first and second body members toward the open position; and wherein the first and second jaw portions each include gripping means for graspingly engaging an object positioned between the first and second jaw portions in response to the first and second body members being moved from the open position to the gripping position.

2. A gripping tool as defined by claim 1 further comprising a light source retained by at least one of the first and second body portions, the light source being directed toward the first and second jaw portions.

3. A gripping tool as defined by claim 2 wherein the light source is a pen light removably positioned between the first and second body members.

4. A gripping tool as defined by claim 1 wherein each of the gripping means is a serrated surface defined by a tip portion of at least one of the jaw portions.

5. A gripping tool as defined by claim 4 wherein the tip portion of at least one of the jaw portions defines at least one slot extending from an end of the jaw portion to allow a portion of a connector to be disposed therein.

6. A gripping tool as defined by claim 1 wherein each of the first and second jaw portions is elongated.

7. A gripping tool as defined by claim 6 wherein each of the first and second jaw portions is tapered.

8. The gripping tool of claim 1, wherein the gripping means is a tip portion removably couplable to at least one of the first and second jaw portions.

9. The gripping tool of claim 8 wherein the tip portion is comprised of a plurality of tip portions each adapted to different tasks.

10. The gripping tool as defined by claim 1 wherein the biasing means is comprised of a spring.

11. A gripping tool as defined by claim 1 wherein one of the first and second body members defines a pair of generally opposed, outwardly projecting pins and the other of the first and second body portions defines a pair of generally opposed apertures each adapted to pivotally receive one of the pins.

12. The gripping tool of claim 1, further including a stop for restricting an amount by which the first and second jaw portions can be brought together.

13. A gripping tool comprising:

a first body member formed from a dielectric material, the first body member having a first jaw portion and a first handle portion, the first jaw portion extending longitudinally outward from the first handle portion;

a second body member formed from a dielectric material, the second body member having a second jaw portion and a second handle portion, the second jaw portion extending longitudinally outward from the second handle portion;

a hinge assembly pivotally coupling the first and the second handle portions to one another at distal ends of their respective handle portions wherein a downward force applied to the body members moves the body members into a substantially parallel arrangement between an open position and a gripping position;

a biasing element disposed between the first and the second body members, the biasing element urging at least one of the first and second body members toward the open position; and a gripping element disposed on at least one of the first and second jaw portions;

wherein the gripping element graspingly engages an object positioned between the first and second jaw portions in response to the first and second body members being moved from the open position to the gripping position.

14. The gripping tool of claim 13, wherein the hinge assembly is comprised of:

a pair of pins outwardly projecting from the second handle portion of the second body member; and a pair of apertures in the first handle portion of the first body member;

wherein the apertures receive the pins for pivotally movement of the first and second body members.

15. The gripping tool of claim 13, wherein the biasing element is comprised of a spring.

16. The gripping tool of claim 13, wherein the gripping element is comprised of serrations disposed on a surface of at least one of the first and second jaw portions.

17. The gripping tool of claim 13, wherein the gripping element includes a slot extending from a tip of at least one of the first and second jaw portion.

18. The gripping tool of claim 13, wherein the gripping element is removably couplable to at least one of the first and second jaw portions.

19. The gripping tool of claim 13, further including a stop for restricting an amount by which the first and second jaw portions can be brought together in the gripping position.

20. The gripping tool of claim 13, wherein the gripping element is a tip portion removably couplable to at least one of the first and second jaw portions.

* * * * *